United States Patent [19]

Kaimo

[11] Patent Number: 4,812,098

[45] Date of Patent: Mar. 14, 1989

[54] DEVICE FOR JOINING TOGETHER BUILDING UNITS

[75] Inventor: Matti O. Kaimo, Virkkala, Finland

[73] Assignee: Oy Lohja Ab, Nummela, Finland

[21] Appl. No.: 111,273

[22] Filed: Oct. 22, 1987

[30] Foreign Application Priority Data

Oct. 27, 1986 [FI] Finland ..... 864338

[51] Int. Cl.[4] ..... F16B 19/00; F16C 11/06

[52] U.S. Cl. ..... 411/360; 411/513; 411/541; 403/155; 403/326

[58] Field of Search ..... 411/320, 360–365, 411/353, 447, 513, 515, 517, 541, 540; 403/155, 324, 326, 371, 377; 29/438–440, 509, 515; 228/165, 168, 173.3, 173.6, 174

[56] References Cited

U.S. PATENT DOCUMENTS

| | | | |
|---|---|---|---|
| 1,819,380 | 8/1931 | Osborne | 411/513 |
| 2,345,918 | 4/1944 | Dahlstrand | 228/165 |
| 2,411,301 | 11/1946 | Stanitz | 228/173.6 |
| 3,823,464 | 7/1974 | Chartet | 228/165 |
| 3,884,589 | 5/1975 | Liedholm | 411/353 |

FOREIGN PATENT DOCUMENTS

| | | |
|---|---|---|
| 57293 | 7/1980 | Finland . |
| 58669 | 3/1981 | Finland . |

*Primary Examiner*—Neill R. Wilson

*Attorney, Agent, or Firm*—Finnegan, Henderson, Farabow, Garrett & Dunner

[57] ABSTRACT

The present invention relates to a device for joining together building units, comprising a lock housing (2) positioned in one building unit; a peg (3) positioned in the other building unit and arranged to be inserted into the lock housing, the end of the peg being provided with a flange (8); and a means for locking the peg (3) in the lock housing in the longitudinal direction thereof. In order to prevent the sideward movement of the peg with respect to the lock housing, prior devices comprise a second ring flange attached to the peg at an inlet (9) of the lock housing. The second flange can be omitted, if the bottom plate (1) of the other unit is bent into a collar (10) which surrounds the peg (3) and is attached thereto.

2 Claims, 2 Drawing Sheets

DEVICE FOR JOINING TOGETHER BUILDING UNITS

The present invention relates to a device for joining together building units, comprising a lock housing positioned in one building unit; a metal plate positioned in the other building unit and provided with a hole; a peg arranged to be inserted through the hole and attached to the edge of the hole, the peg being arranged to be inserted into the lock housing in the joined position of the units and being provided with a flange at the free end thereof; and a locking means arranged to be inserted into the lock housing for locking the peg in the housing in the direction of the longitudinal axis thereof Finnish Patent Specification Nos. 57 293 and 58 669 disclose an extension joint for concrete piles in which the piles are fastened to each other by means of pegs provided on the joint faces and arranged to be inserted into lock housings so as to be locked therein. The pegs are locked in the lock housings in the direction of the longitudinal axis of the pegs by means of locking means cooperating with a flange provided at the end of the pegs.

In order that a peg provided with a flange could be inserted into the lock housing, the diameter of the inlet of the housing has to be at least equal to the diameter of the flange In order to prevent a sideward displacement of the peg in the lock housing during the mounting, it is known to attach a second ring-shaped flange to the peg by welding so as to be positioned at a distance from the first-mentioned flange positioned at the end of the peg, whereby the diameter of the second flange corresponds to that of the inlet of the lock housing The locking means surrounds the peg between the flanges.

A drawback of this known device is the complicated structure of the peg and the high costs of manufacture caused by the assembly of a plurality of parts.

The object of the present invention is to provide a device in which a peg simpler than previously can be used. The device according to the invention is characterized in that the edge of the hole provided in the metal plate of the other unit forms a collar which projects from the plate in the direction of the free end of the peg.

When the edge of the hole of the metal plate is formed into a collar to which the peg is attached, a bulge replacing the second flange is formed around the peg in a simple manner. The flange is easy to manufacture simultaneously with the manufacture of e.g. the end plate of a concrete pile, by the deep drawing technique. The collar also makes the metal plate stiffer than previously.

Figure 1:
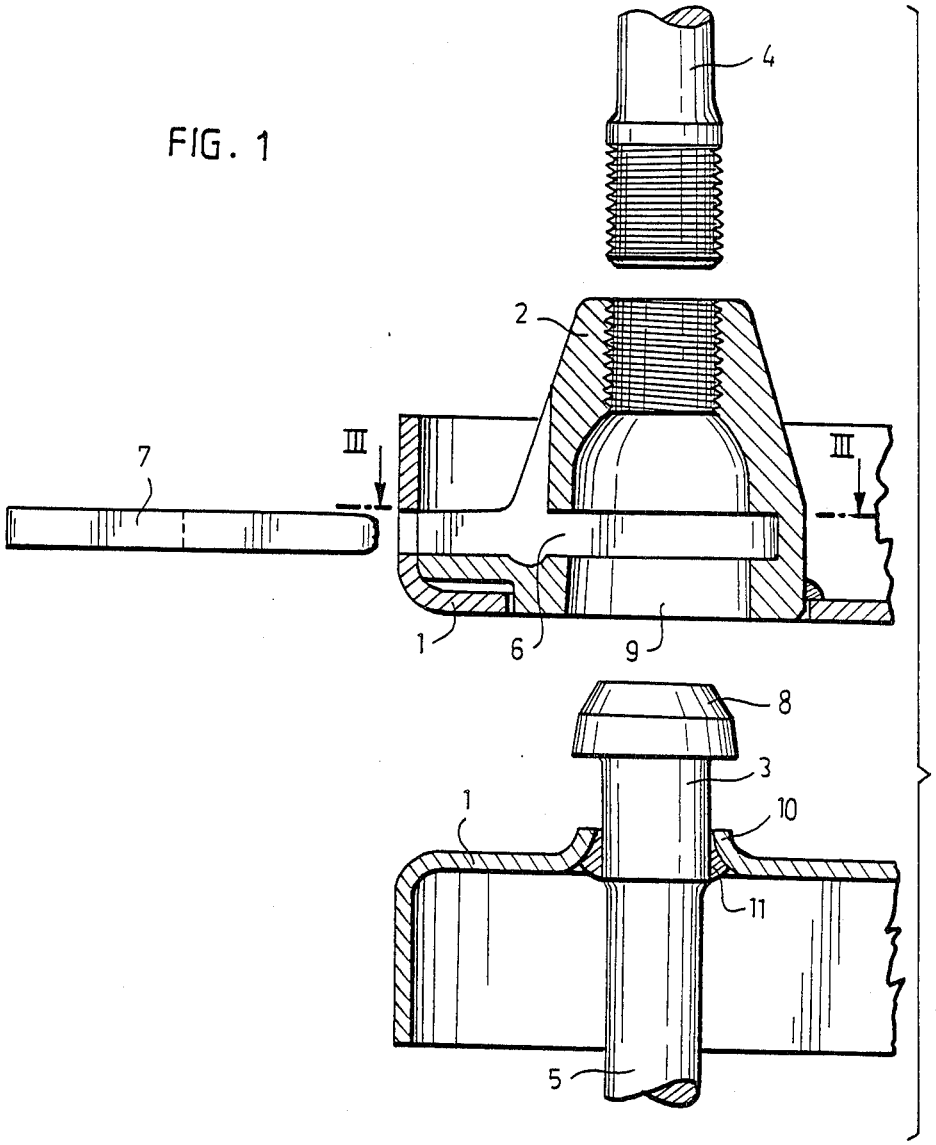
Figure 3:
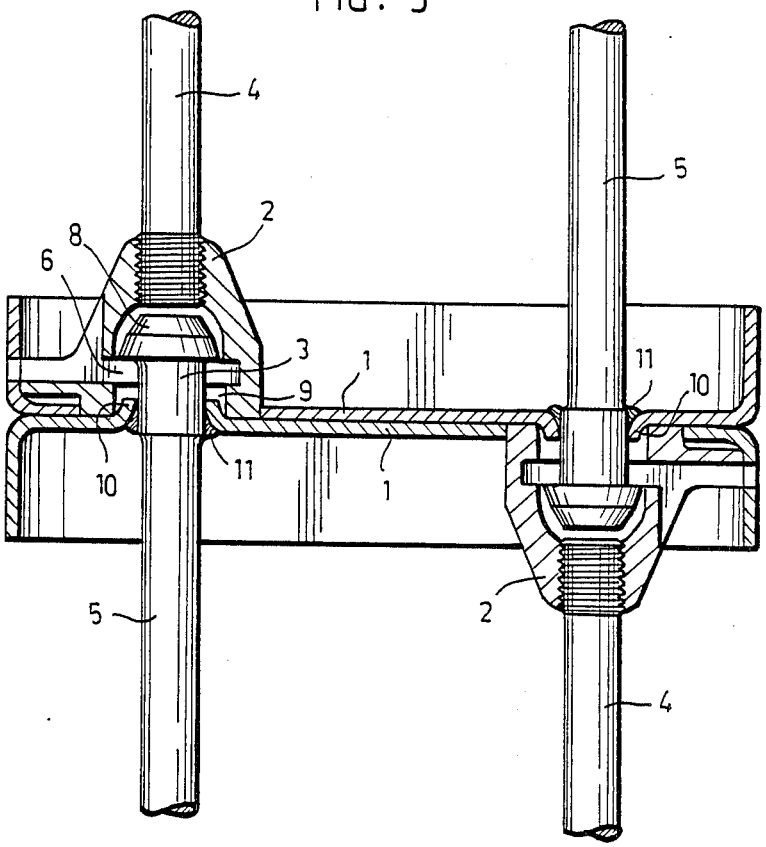
Figure 2:
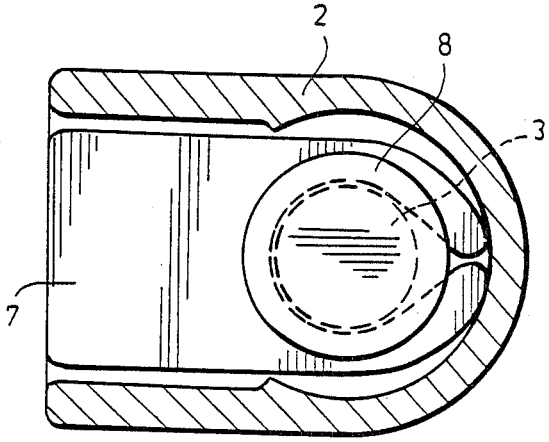

In the following a preferred embodiment of the invention will be described in more detail with reference to the attached drawings, wherein FIG. 1 ilustrates the joint means of building units in a section perpendicular to the faces to be joined, FIG. 2 is a horizontal sectional view of a lock housing along the line III . . . III of FIG. 1, and FIG. 3 illustrates the invention when applied to concrete piles.

FIG. 1 shows a joint between two concrete building units. The joint faces of the units are provided with steel plates 1 to which e.g. two lock housings 2 and two pegs 3 are fastened at holes. The lock housings and the pegs are so positioned in the joint faces of the building units that when the units are positioned one upon the other, the pegs are inserted into the lock housings as shown in FIG. 1. Concrete steels 4 are fastened in the lock housings 2, and the pegs 3 are formed by concrete steels 5 projecting outside the steel plate and attached thereto.

An opening 6 is provided in the side wall of the lock housings, through which opening a two-branch locking means 7 is knocked into the lock housing so that the branches surround the peg 3.

The free end of the peg is provided with a ring flange 8 preferably integral with the peg 3 and formed by jolting the end of the concrete steel 5. The function of the flange 8 is to lock the peg in the longitudinal direction thereof in the lock housing by means of the locking means 7. In order that the peg could be inserted into the lock housing 2, an inlet 9 of the lock housing has a diameter at least equal to the diameter of the flange 8.

According to the invention there is a collar 10 provided in the steel plates 1 around the holes through which the peg is passed. The collar projects from the plate outwards, i.e. in the direction of the free end of the peg. The pegs are fastened to the inner surface of the collars by means of a weld joint 11 over the whole height of the collars. By means of the collar a ring-shaped bulge is formed in the peg; this bulge replaces a separate flange known from the prior art and prevents the sideward movement of the peg in the inlet 9 of the lock housing. It is obvious that the outer diameter of the collar shall substantially correspond to the diameter of the inlet 9 in order that the peg could be locked in place in the sideward direction. Due to the arched shape of the collar, however, the diameter of the collar at the free edge need not be equal to the diameter of the inlet 9, see FIG. 3.

The collar 10 is preferably manufactured simultaneously with the shaping of the steel plate 1, generally by deep drawing.

The building units, e.g. concrete piles as in FIG. 3, are joined together by placing the units one upon the other as shown in FIG. 3 and by knocking the locking means 7 in place in the lock housings so that the branches are positioned around the peg 3 as shown in FIG. 3. It is possible by means of the device according to the invention to join together any kind of building units.

I claim:

1. A device for joining together building units, comprising a lock housing positioned in a first building unit; a metal plate positioned in a second building unit and provided with a hole; a peg having a free end arranged to be inserted through the hole and attached to the edge of the hole, the peg being arranged to be inserted into the lock housing in the joined position of the units and being provided with a flange at the free end thereof; and a locking means arranged to be inserted into the lock housing for locking the peg in the housing in the direction of the longitudinal axis thereof, the edge of the hole provided in the metal plate of the second unit forming a collar which projects from the plate in the direction of the free end of the peg.

2. A device according to claim 1, wherein the peg is fastened to the collar by welding over the entire height of the collar.

* * * * *